US007857065B2

(12) United States Patent
Hansen

(10) Patent No.: US 7,857,065 B2
(45) Date of Patent: Dec. 28, 2010

(54) DEVICE FOR SELECTIVE MOVEMENT OF WELL TOOLS AND ALSO A METHOD OF USING SAME

(75) Inventor: Henning Hansen, Dolores Alicante (ES)

(73) Assignee: Ziebel AS, Stavanger (NO)

( * ) Notice: Subject to any disclaimer, the term of this patent is extended or adjusted under 35 U.S.C. 154(b) by 235 days.

(21) Appl. No.: 11/915,577

(22) PCT Filed: May 18, 2006

(86) PCT No.: PCT/NO2006/000183

§ 371 (c)(1),
(2), (4) Date: Nov. 26, 2007

(87) PCT Pub. No.: WO2006/126886

PCT Pub. Date: Nov. 30, 2006

(65) Prior Publication Data

US 2008/0202768 A1 Aug. 28, 2008

(30) Foreign Application Priority Data

May 27, 2005 (NO) ..... 20052539

(51) Int. Cl.
*E21B 31/06* (2006.01)

(52) U.S. Cl. ..... 166/381; 166/66.5

(58) Field of Classification Search ..... 166/66.5, 166/105, 381

See application file for complete search history.

(56) References Cited

U.S. PATENT DOCUMENTS

| | | | | |
|---|---|---|---|---|
| 1,840,994 | A | 1/1932 | Winsor | |
| 3,548,273 | A * | 12/1970 | Parodi et al. | 318/135 |
| 4,548,552 | A * | 10/1985 | Holm | 417/417 |
| 4,562,385 | A * | 12/1985 | Rabson | 318/135 |
| 4,687,054 | A * | 8/1987 | Russell et al. | 166/66.4 |
| 4,815,949 | A * | 3/1989 | Rabson | 417/417 |
| 5,620,048 | A * | 4/1997 | Beauquin | 166/62 |
| 5,734,209 | A | 3/1998 | Hallidy | |
| 5,831,353 | A * | 11/1998 | Bolding et al. | 310/12.15 |
| 5,960,875 | A * | 10/1999 | Beauquin et al. | 166/66.4 |
| 6,288,470 | B1 * | 9/2001 | Breit | 310/254.1 |
| 6,700,252 | B2 * | 3/2004 | Fleshman et al. | 310/87 |
| 7,378,769 | B2 * | 5/2008 | Head | 310/87 |
| 2002/0197174 | A1 | 12/2002 | Howard | |

* cited by examiner

*Primary Examiner*—Daniel P Stephenson
*Assistant Examiner*—Blake Michener
(74) *Attorney, Agent, or Firm*—Patterson & Sheridan, L.L.P.

(57) ABSTRACT

A device for use in the selective movement of a well tool in or through at least a portion of a pipe string. The portion of the pipe string being provided with a plurality of electromagnets which are arranged to produce a magnetic field in order to move the well tool within the portion of the pipe string by means of magnetic influence on the well tool. A method for selective movement of a well tool in or through at least a portion of a pipe string.

12 Claims, 5 Drawing Sheets

DEVICE FOR SELECTIVE MOVEMENT OF WELL TOOLS AND ALSO A METHOD OF USING SAME

BACKGROUND OF THE INVENTION

1. Field of the Invention

The present invention relates to a device for the selective propulsion or movement of a well tool. More particularly, it relates to a device for controlling the movement of a well tool which is used in petroleum wells in connection with the recovery of petroleum products or servicing/intervention in petroleum wells. The movement in the form of propulsion and/or rotation of the well tool is provided by means of magnetic forces. The invention also relates to a method for the selective movement of a well tool in or through at least a portion of a pipe string.

By the concept well tool is meant herein any equipment which is arranged to be run into and operated within a well in connection with the operation and servicing thereof.

2. Description of the Related Art

According to prior art a well tool is run into the well by being lowered, under the influence of gravity, into the well, hanging on, for example, a steel rope, a so-called "wireline". In portions of the well, in which gravity cannot be utilized to drive the tool into the well, propelling devices may be used, such as so-called well tractors, pulling or pushing the tool in the longitudinal direction of the well. In some cases so-called coiled tubing is also used to drive the well tool to its location of use.

There are several drawbacks related to the prior art mentioned above.

The above-mentioned prior art is based on there being a physical connection between the well tool and a portion of the well located on the surface. To prevent leakages from the well into the atmosphere, extensive surface lock-gate tools are required. In addition extensive run-in equipment is required and a manning of 2 to 10 persons, depending on what equipment is to be run into the well. In addition, the area at the well surface is considered to be a hazardous area for personnel because of pressurized equipment, movable parts and the lifting and moving of heavy equipment.

Due to the extensive equipment required and the hazards connected with the above-mentioned prior art operations, it is a time-consuming process to install the well tool and pressure test the surface pressure control system of the well. This entails that the production from the well will have to be shut down for a relatively long time. Additionally, for reasons of safety, it may be necessary to shut down wells located in the area where heavy equipment is being lifted.

The invention has as its object to remedy or at least reduce one or more drawbacks of the prior art.

SUMMARY OF THE INVENTION

The object is achieved through the features specified in the description below and in the subsequent Claims.

In this document positional specifications, such as "upper" and "lower", "bottom" and "top" or "horizontal" and "vertical", refer to the position that the equipment is in the following figures, which may also be a natural, necessary or practical position of use.

In one aspect the present invention is constituted by a device for the selective movement of a well tool in or through at least one portion of a pipe string, said at least one portion of the pipe string being provided with a plurality of electromagnets which are arranged to move the well tool in said at least one portion by means of magnetic influence on said well tool. By the concept selective propulsion is meant, in this connection, that the movement of the well tool, with respect to both the direction of propulsion and/or the direction of rotation and also the speed within the pipe string, is arranged to be controlled from a control room on a drilling rig, for example. To provide as much protection as possible against external influence, each single electromagnet is preferably integrated, partially or entirely, into a substantially complementary recess in a portion of the internal wall surface of the pipe string.

Whenever there is a need for movement of the well tool in the longitudinal direction of the pipe string, said plurality of electromagnets in the at least one portion of the pipe string are placed, in one embodiment, one behind the other in the longitudinal direction of the pipe string. For the propulsion through the longitudinal direction of the pipe string it is advantageous, but not necessary, for said plurality of electromagnets to be annular and extend around a portion of the internal wall surface of the pipe string.

In one embodiment each one of said plurality of electromagnets that are placed one behind the other in the longitudinal direction of the pipe string, is constituted by at least one chip-like electromagnet located in only a portion of the internal circumferential portion of the pipe string. Preferably, two or more chip-shaped electromagnets are approximately equally spaced around a portion of the internal wall surface of the pipe string. In a preferred embodiment the chip-shaped electromagnets which are arranged one behind the other in the longitudinal direction of the pipe string, are placed on one or more lines extending substantially parallel to the centre axis of the pipe string. In alternative embodiments the chip-shaped electromagnets which are arranged one behind the other in the longitudinal direction of the pipe string, are placed randomly or along lines which do not extend parallel to the centre axis of the pipe string, for example but not limited to lines extending helically round the longitudinal axis of the pipe string.

When there is a need for a well tool to be rotated in a portion of a well pipe, for example a rotary pump, said plurality of electromagnets is placed in a portion of the well pipe and distributed substantially equally spaced round a portion of the well pipe. The electromagnets are arranged to create a magnetic field which moves in terms of rotation in a plane substantially perpendicular to the longitudinal axis of the pipe string. A well tool, such as a pumping device, could thereby be influenced by the magnetic field to rotate around the centre axis of the well pipe.

The power supply to the electromagnets is controlled sequentially between the individual adjacent-magnets by means of control devices known per se. The polarity of the individual magnet is synchronized with the movement of the well tool and thereby with the magnetic influence on the well tool, either to provide propulsion along the longitudinal axis of the well pipe or pipe string, or to provide rotation of the well tool around the centre axis of the well pipe in the desired direction and at the desired speed.

To be able to ensure that the well tool is moved substantially centred in the pipe string, the well tool is provided, in a preferred embodiment, with centering or guiding devices. In their simplest form, the guiding devices may be constituted by mechanical means known per se, such as, but not limited to, rolling devices or other guiding means substantially bearing on portions of the internal wall surface of the pipe string. Alternatively or in addition to said mechanical guiding devices, the guiding device or centring means of the well tool may be constituted by magnets, which are used in a manner known per se, for example as known from lateral guiding of so-called "MagLev" trains, to centre the well tool in a pipe string.

When there is a need for magnetic forces that are more powerful than the forces provided by the influence of the electromagnets on the well tool alone, the well tool may also be provided with magnets cooperating with the electromagnets placed in the wall portion of the pipe string. Preferably, the magnets, which are placed on or integrated into the well tool in such a case, are permanent magnets. Even though electromagnets placed on the well tool could provide a further enhanced magnetic effect compared with said permanent magnets, electromagnets placed on the well tool have the disadvantage of the well tool then requiring a power supply and thereby cables extending between the well tool and the surface of the well. Essential, advantageous features of the invention will thereby be lost.

The invention also relates to a method for the selective movement of a well tool in or through at least a portion of a pipe string, the method including the following steps:

- providing at least a portion of the pipe string with a plurality of electromagnets;
- running the well tool into the pipe string and to said at least one portion of the pipe string which is provided with electromagnets; and
- controlling the polarity of the individual magnets sequentially, so that the desired movement of the well tool is achieved.

BRIEF DESCRIPTION OF THE DRAWINGS

In the following there is described a non-limiting exemplary embodiment of a preferred embodiment which is visualized in the accompanying drawings, in which like or corresponding parts are indicated by the same reference numeral, and in which.

DETAILED DESCRIPTION

Figure 1:
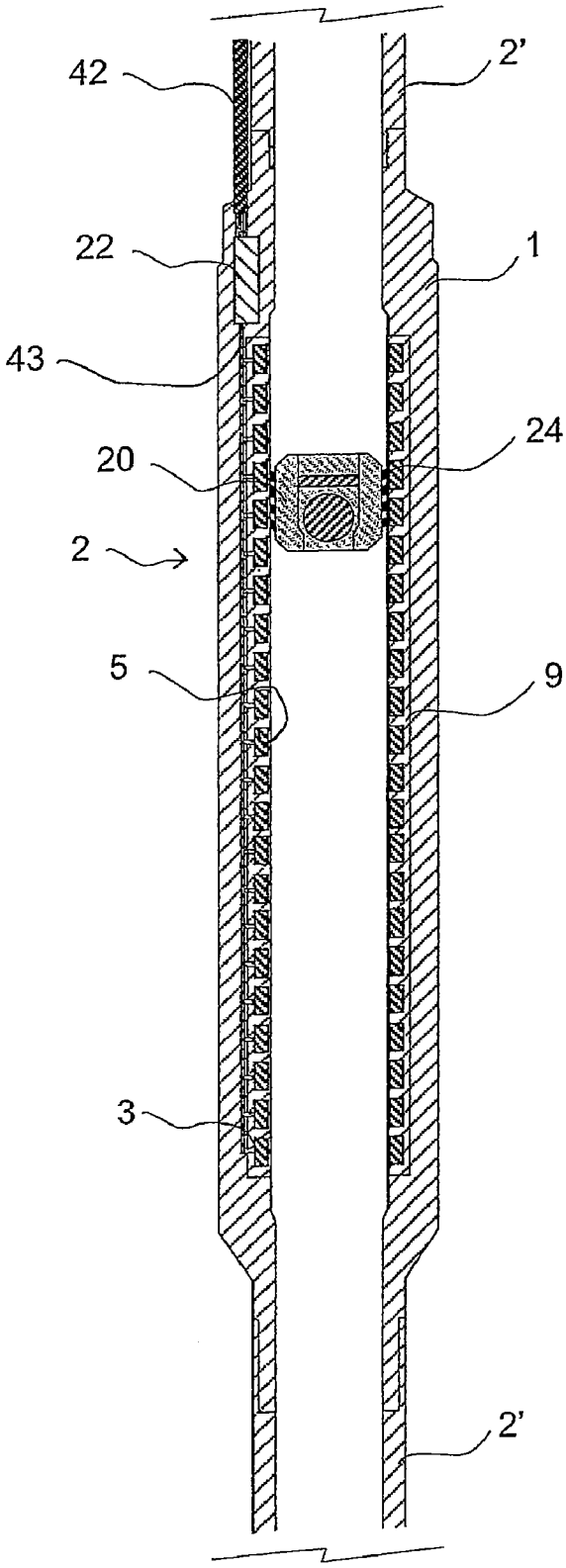
FIG. 1 shows a cross-sectional view of a portion of a well which is provided, in an internal portion, with electromagnets, and in which a valve device is arranged to be moved in the portion with electromagnets.

In the figures the reference numeral 1 indicates a well pipe forming a portion of a pipe string 2 and being provided, in a portion, with a plurality of electromagnets 3 which are fixed in a recess 5 in the well pipe 1. Thus, the electromagnets 3 will have a portion exposed to the well. To avoid direct exposure to the well a protectant (not shown) may be applied to the outside of the electromagnets 3. Such a protectant may be for example, but not limited to, a suitable type of pipe or a coating which is fit to resist the environment of the well.

The electromagnets 3 are supplied with power from the surface through a power cable 42, control system 22 and power cable 43. In an alternative embodiment (not shown) the electromagnets 3 are supplied with power from the surface through a cable integrated into a portion of the pipe string 2. The electrical connection between the individual well pipes 1 is provided in the latter case by means of electrical connections which are integrated into the threaded portions of the individual pipes 1, which are used to form the pipe string 2.

In FIG. 1 is shown a well tool which is constituted by a check valve 20, known per se, inserted into a well pipe 1. The well pipe 1 is provided with twenty-two electromagnets 3 equally spaced within the recess 5 in the internal wall surface of the well pipe 1. The electromagnets 3 are fixed to the well tool 1 by means of a securing means 9, such as, but not limited to, composite material, ceramic material or metal. In the embodiment shown the electromagnets 3 have an internal pipe diameter substantially corresponding to the diameter of the internal diameter of the well pipe 1 immediately above and below the portion with electromagnets 3.

The check valve 20 in FIG. 1 is arranged to be driven up and down along the electromagnets 3 in the well pipe 1 by sequential application of current to the electromagnets 3 by means of a control system 22 known per se. A skilled person will understand that the entire check valve 20 or parts thereof must be of a magnetizable material, so that the magnetic field generated by the electromagnets 3 may influence and thereby drive the check valve 20 in a desired direction upwards or downwards along the longitudinal axis of the well pipe 1.

To achieve sufficient fluid-tightness in the annulus between the check valve 20 and the portion with electromagnets 3 and also the securing means 9, the check valve 20 is provided with flexible bushings 24 arranged to be brought to bear on the electromagnets 3 and the securing means 9, at least when the check valve 20 is driven in the upward direction in the well pipe 1. The bushings 24 could also effect centring of the check valve 20 in the well pipe 1.

The way the check valve 20 is configured in FIG. 1, it could also work as a free-running piston arranged to pump fluid up the pipe string 2. The pipe string 2 is constituted by the well pipe 1 and the well pipes 2' which are connected to the end portions of the well pipe 1. Thereby, fluid may be pumped in the pipe string 2 without the pumping device, here constituted by a simple check valve 20, having connected cables or physical driving devices of any kind.

To prevent the check valve 20 from being moved out of the portion with electromagnets 3, the well pipe 1 is provided with portions of reduced internal diameter in relation to the diameter of the portion of the well pipe 1 in which the check valve 20 can be moved. Such a precautionary measure is important should an uncontrolled loss of power supply to the electromagnets 3 occur. A skilled person will know that the check valve 20 is arranged to be expanded to the desired diameter after having been run in to the desired position in the well, and that it is arranged to be retracted to the necessary reduced diameter by means of a pulling tool (not shown), known in itself, which is used in connection with the extraction of the check valve 20.

Figure 2:
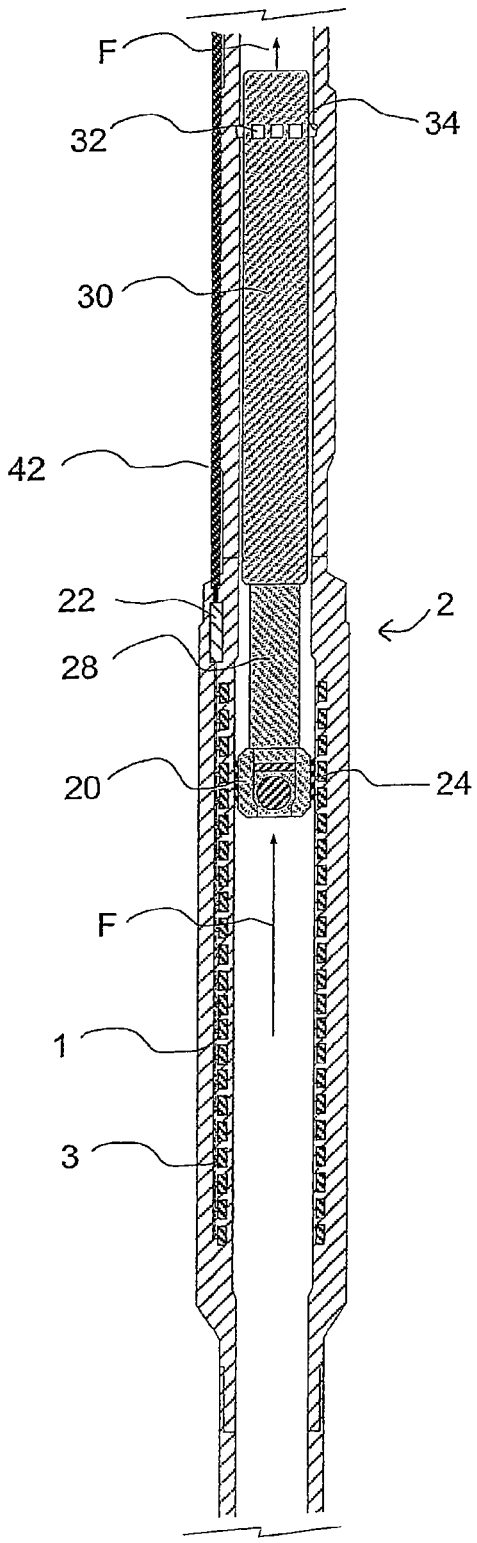
FIG. 2 shows, on a smaller scale, a cross-sectional view of the well portion of FIG. 1, but the valve device is connected to a pumping device through a stay, the valve device being close to its upper position.
Figure 3:
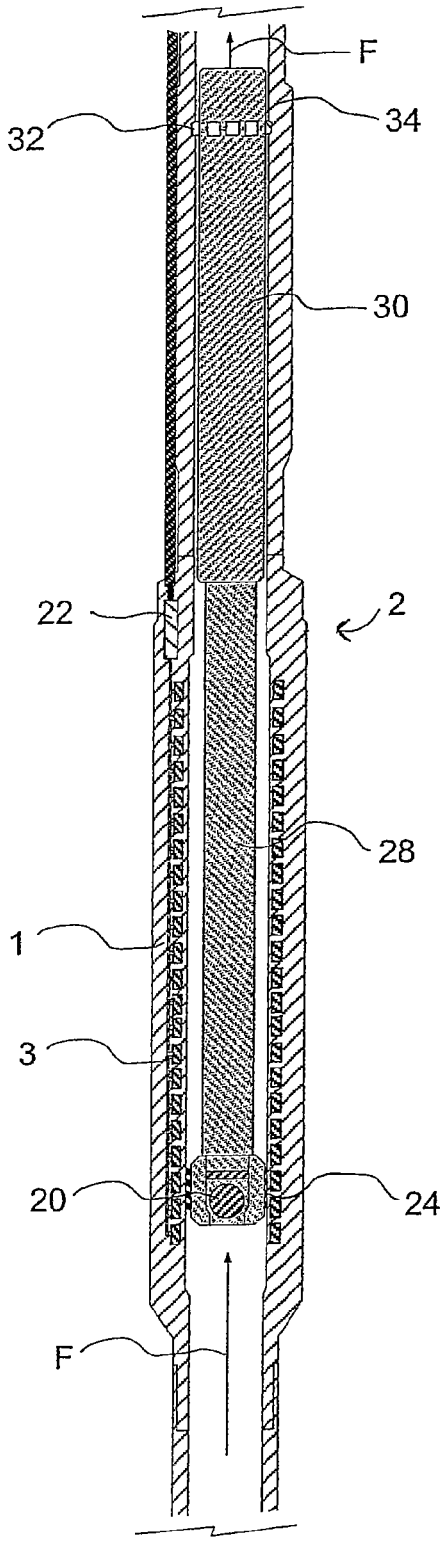
FIG. 3 shows the same as FIG. 2, but the valve device is near its lower position.

FIGS. 2 and 3 show a check valve 20 run into a well pipe 1. In an internal portion 5 the well pipe 1 is provided with a plurality of electromagnets 3 corresponding to the embodiment discussed in connection with FIG. 1 above. In the embodiment shown the check valve 20 is connected to a stay 28 which is connected in its turn to a pumping unit 30. The pumping unit 30 is constituted by a single- or double-acting pump known per se. The check valve 20, stay 28 and pumping unit 30 form a pumping device which is arranged to be driven by the check valve 20 being moved up and down along the electromagnets 3 in the well pipe 1 by sequential application of power to the electromagnets 3 by means of a control system 22. FIGS. 2 and 3 show two different positions of the check valve 20 and stay 28 relative to the pumping unit 30.

To ensure that the pumping device 20, 28, 30 is secured at the desired location in the well, the pumping unit 30 is provided with a latching device 32 which is arranged, in a manner known per se, for example by means of spring-loaded latching elements, to be brought into engagement with complementary recesses 34 in a portion of the pipe string 2. The latching device 32 can be disengaged from the recesses 34 by means of a pulling tool (not shown), known per se. In FIGS. 2 and 3 a fluid flow which is provided by the pumping device is shown by the arrows F.

Figure 4:
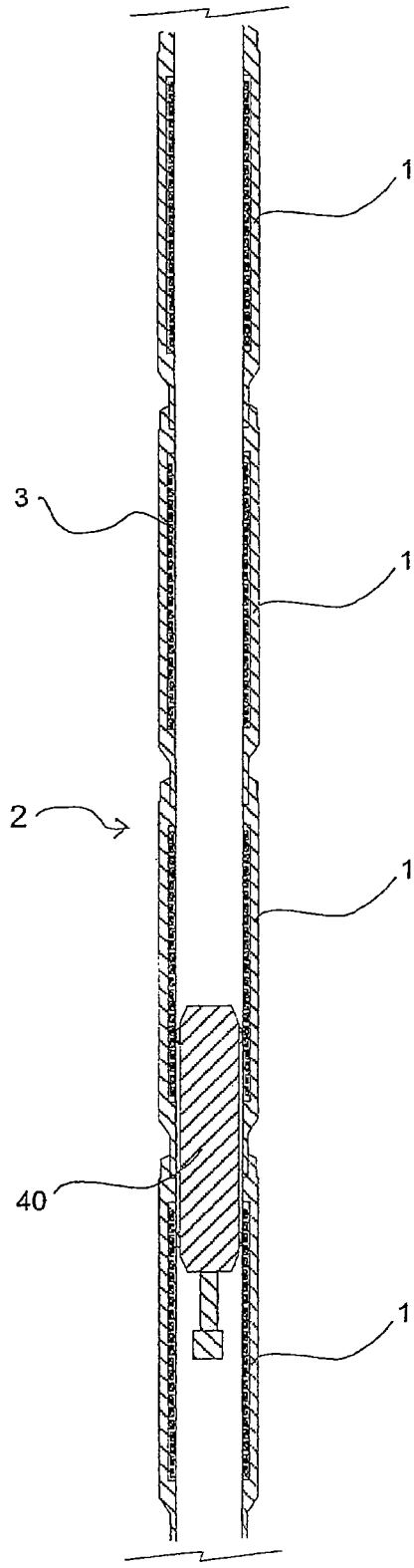
FIG. 4 shows, on a smaller scale, a cross-sectional view of a portion of a well, in which a well intervention tool is passed along the well pipe by means of portions with electromagnets.

FIG. 4 shows a plurality of well pipes 1 corresponding to the well pipe 1 which is mentioned in connection with FIGS. 1-3 above and which is provided with a plurality of electromagnets 3. The well pipes 1 are screwed together and form a portion of a pipe string 2. A well intervention tool 40 is arranged to be driven in the pipe string 2 by the electromagnets 3 causing, by means of control devices 22 (not shown), known per se, movement of the magnetic field in one direction or the other of the pipe string 2. As mentioned above, the speed of the tool 40 in the pipe string can also be controlled. The electromagnets 3 are supplied with power from the surface through a cable (not shown) which is integrated into a portion of the pipe string 2. The electrical connection between the individual well pipes 1 is provided by means of electrical connections integrated into the threaded portions of the individual pipes 1, which are used to form the pipe string 2. In an alternative embodiment (not shown) power is provided to the electromagnets via a cable 42 (see FIG. 7, for example) extending on the outside of the pipe string 2.

To ensure that the magnetic field provided by the electromagnets 3 will continuously influence the tool 40, the distance between the groups of electromagnets 3 in two interconnected well pipes 1 is preferably smaller than the extent of the tool 40 in the longitudinal direction of the pipe string 2.

In FIG. 4 is indicated that the entire pipe string 2 is constituted by a number of well pipes 1 which are provided with electromagnets 3. By such a solution the tool 40 could be moved in the pipe string 2 without any further physical connection to the surface of the well. However, for economic and/or practical reasons it may be desirable in some cases to provide only portions of a pipe string 2 with electromagnets 3. Such a case may be, for example, when the tool 40 could not be run into the well only by means of gravity alone. Such a situation could arise at horizontal portions of a well or in portions where the well has a gradient in an upstream direction. In such cases, portions having electromagnets 3, as shown in FIG. 4 for example, could drive the tool 40 forwards without the use of, for example, so-called well tractors or some other known running tool. For the tool 40 to be pulled out of the well and against the action of, for example, gravity, the well tool 40 may be connected, in a manner known in itself, to a so-called wireline connecting the tool 40 with the surface.

Figure 5:
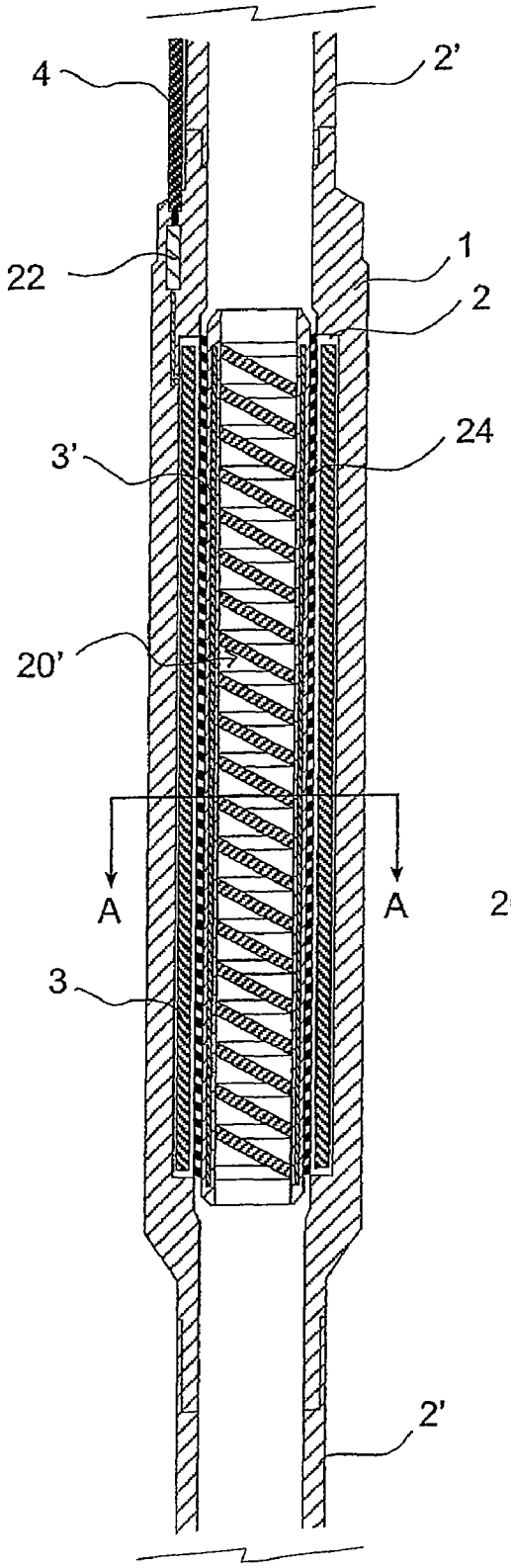
FIG. 5 shows, on a larger scale, a cross-sectional view of a portion of a well pipe, in which electromagnets are placed in an internal portion of the pipe string, and in which a pumping device is arranged to be rotated, under the influence of electromagnetic forces, round the centre axis of the well pipe.
Figure 6:
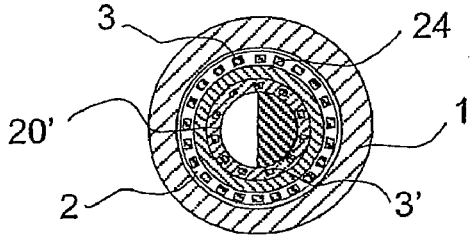
FIG. 6 shows the pumping device of FIG. 5, viewed in section through the line A-A of FIG. 5.

FIGS. 5 and 6 show cross-sectional views, a side view and a sectional view, respectively, of a pump 20' provided with several permanent magnets 3' equally spaced in an outer mantle portion of the pump 201. The pump 20' is placed in a well pipe 1 which is provided with a plurality of electromagnets 3 in its internal wall surface. A control device 22 is arranged, in a manner known per se, to control sequentially the supply of power to the individual electromagnet 3, whereby a rotating magnetic field could be provided, influencing said permanent magnets 3' in such a way that they rotate the pump 20' in the desired direction and at the desired speed around the centre axis of the pump 20'. To provide sealing between the periphery of the pump 20' and the internal wall surface of the pipe, the pump 20' is provided with bushings 24 that could provide centring of the pump 20' in the pipe 1. Other types of centring devices as mentioned above could also be used.

In the exemplary embodiments shown in FIGS. 1-3 and 5-6 the cables 42 leading current from the surface down to the electromagnets 3 and the control system 22 therefor, are shown to be placed on the outside of the pipe string 2.

Figure 7:
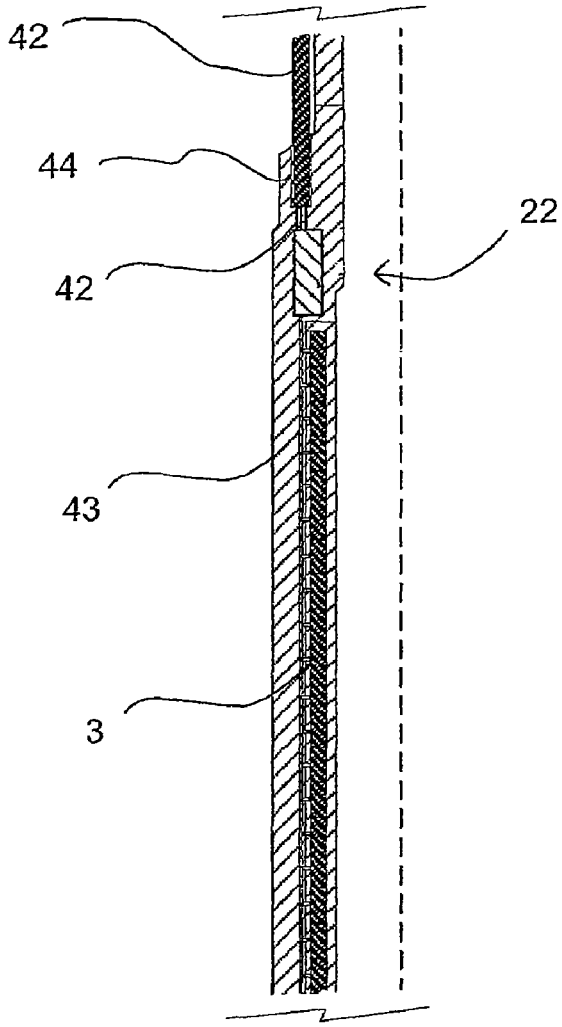
FIG. 7 shows, on a larger scale, details of a portion of a pipe string which is provided with electromagnets, and in which a control device for the sequential distribution of power to the individual electromagnet is shown to be placed in a portion of the well pipe.

In FIG. 7 is shown a section of a portion of a pipe 1, in which the end portion of an electrical cable 42 is embedded in a portion of the pipe 1 which is provided with electromagnets 3. The individual electromagnet 3 is supplied with power from a control system 22 known per se and through cable 43 which are connected to said electrical cable 42. A skilled person will recognize that the terminal portion 44 of the cable 42 in the pipe 1 is secured against fluid penetration.

Figure 8:
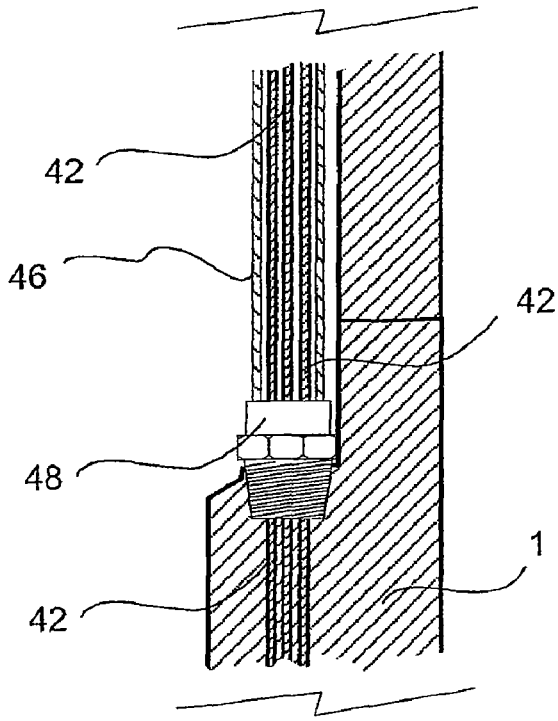
FIG. 8 shows an embodiment of a possible solution for the connection of electrical conductors from the outside of a pipe string.

In FIG. 8 electrical cables 42 are placed in so-called "coiled tubing" 46. The cables 42 are connected to a portion of a pipe 1 which is provided with electromagnets (not shown), and the connection is sealed by means of a standard type pipe connection 48, for example of a type sold under the trade mark Swagelok.

The invention claimed is:

1. A device for selective movement of a well intervention tool along at least a portion of a pipe string, the pipe string having at least two successive well pipes connected by a threaded engagement portion, the movement being provided by a magnetic field acting on the well intervention tool, the magnetic field being provided by a plurality of electromagnets being positioned along an inner wall of said at least two successive well pipes, the well intervention tool being arranged to be moved, under the influence of the electromagnets alone, in a desired direction through said at least two successive well pipes and wherein the well intervention tool has a total length shorter than a length of a single well pipe.

2. The device in accordance with claim 1, wherein at least one out of said plurality of electromagnets is annular and is positioned in a portion of the internal wall portion of the pipe string.

3. The device in accordance with claim 1, wherein the well intervention tool is provided with centring devices which are arranged substantially to centre the well intervention tool within the pipe string.

4. The device in accordance with claim 1, wherein cables for the supply of power to the electromagnets are placed on the outside of the pipe string.

5. The device in accordance with claim 1, wherein cables for the supply of power to the electromagnets are integrated into the individual well pipe, the power being transmitted between the individual well pipes through electrical connections placed in the connecting points of the well pipes.

6. The device in accordance with claim 1, wherein electrical connections between the two successive well pipes are integrated in the threaded engagement portion.

7. The device in accordance with claim 1, wherein the total length of the well intervention tool is longer than the threaded engagement portion.

8. A method for the selective movement of a well intervention tool along at least a portion of a pipe string, the pipe string having at least two successive well pipes, the movement being provided by a magnetic field acting on the well intervention tool and being provided by a plurality of electromagnets positioned in said two successive well pipes, the method comprising:

positioning the well intervention tool in the pipe string, wherein the two successive well pipes are connected by a threaded engagement portion and wherein the well intervention tool has a total length shorter than a length of a single well pipe;

running the well intervention tool through the pipe string until the well intervention tool may be influenced by the electromagnets for further movement along said at least two successive well pipes; and controlling the polarity of the individual electromagnets sequentially, so that the desired movement of the well intervention tool along said at least two successive well pipes is achieved.

9. The method in accordance with claim 8, wherein cables for the supply of power to the electromagnets are placed on the outside of the pipe string.

10. The method in accordance with claim 8, wherein cables for the supply of power to the electromagnets are integrated into the individual well pipe, the power being transmitted between the individual well pipes via electrical connections placed in the interconnecting points of the well pipes.

11. The method in accordance with claim 8, wherein the electrical connections between the two successive well pipes are integrated in the threaded engagement portion.

12. The method in accordance with claim 8, wherein the total length of the well intervention tool is longer than the threaded engagement portion.

* * * * *